US006299095B1

(12) United States Patent
Murfin

(10) Patent No.: US 6,299,095 B1
(45) Date of Patent: Oct. 9, 2001

(54) LIGHT STRAND STORAGE DEVICE

(76) Inventor: Martin J. Murfin, P.O. Box 636, Silverhill, AL (US) 36576

( * ) Notice: Subject to any disclaimer, the term of this patent is extended or adjusted under 35 U.S.C. 154(b) by 0 days.

(21) Appl. No.: 09/517,385

(22) Filed: Mar. 2, 2000

(51) Int. Cl.[7] ..... B65H 75/30

(52) U.S. Cl. ..... 242/395; 242/405; 242/405.3; 242/588.4; 242/588.6; 206/395

(58) Field of Search ..... 242/588, 588.3, 242/588.4, 588.6, 395, 395.1, 398, 405, 405.3; 206/389, 409, 395

(56) References Cited

U.S. PATENT DOCUMENTS

| | | | | |
|---|---|---|---|---|
| 69,845 | * | 10/1867 | Schofield | 242/588 |
| 76,512 | * | 4/1868 | Parker | 242/588 |
| 791,759 | * | 6/1905 | Eddy | 242/405 |
| 1,142,039 | * | 6/1915 | Holcomb | 242/395 |
| 1,377,169 | * | 5/1921 | Maize | 242/588 |
| 2,181,555 | * | 11/1939 | Warp | 242/588.4 |
| 2,455,819 | * | 12/1948 | Smith | 242/395.1 |
| 2,747,732 | * | 5/1956 | Fischer | 206/395 |
| 2,864,493 | * | 12/1958 | Holcombe | 242/588.6 |
| 3,843,071 | * | 10/1974 | Graham | 242/588.6 |
| 3,888,010 | * | 6/1975 | Hyde et al. | 242/405 |
| 3,897,032 | * | 7/1975 | Couch et al. | 242/405 |
| 3,908,277 | * | 9/1975 | Rutty | 242/405 |
| 3,922,790 | * | 12/1975 | Quenot | 242/395.1 |
| 5,033,619 | | 7/1991 | Garis . | |
| 5,064,067 | | 11/1991 | McAllister et al. . | |
| 5,086,988 | * | 2/1992 | LaPoint et al. | 242/395 |
| 5,287,965 | | 2/1994 | Miller . | |
| 5,317,491 | | 5/1994 | Lee . | |
| 5,526,931 | | 6/1996 | White . | |
| 5,653,339 | | 8/1997 | Dobson . | |
| 5,904,329 | * | 5/1999 | Kanome et al. | 206/395 |
| 6,082,662 | * | 7/2000 | Gallien | 242/588.6 |

* cited by examiner

*Primary Examiner*—Emmanuel M. Marcelo
(74) *Attorney, Agent, or Firm*—Kenneth L Tolar

(57) ABSTRACT

A storage device for light strands includes a hollow housing having a shaft rotably mounted therein. The housing includes a bottom wall, a pair of opposing side walls, a rear wall, an open top and an open front. Attached to the front edge of the bottom wall is a flap formed of a plurality of foldable sections having a tongue extending from a leading edge thereof. The flap may be folded about the housing to selectively enclose the open front and top. A hand crank is rotatably mounted to the side wall of the housing and is attached to the shaft for selectively rotating the shaft to wind a light strand therearound. A pair of retaining bands are mounted to the shaft, each for securing the end of a light strand thereto.

10 Claims, 1 Drawing Sheet

LIGHT STRAND STORAGE DEVICE

BACKGROUND OF THE INVENTION

The present invention relates to a storage device for conveniently storing decorative light strands.

DESCRIPTION OF THE PRIOR ART

Decorative light strands are often used during Christmas and similar holidays for decorating trees, shrubbery and both the interior and exterior of buildings. Such light strands are easily entangled when placed into conventional storage devices such as bags or boxes. Furthermore, the entangled light strands are difficult, if not impossible, for a single user to mount to a tree or other object. The present invention relates to a storage device specifically designed for light strands that allows a user to neatly store one or more strands therein.

A myriad of light strand storage devices exist in the prior art. For example, U.S. Pat. No. 5,653,339 issued to Dobson relates to a storage receptacle having a cordage member therein. The cordage member has a handle with opposing terminal ends that fit within slots on opposing top edges of the receptacle.

U.S. Pat. No. 5,526,931 issued to White relates to a carrier for Christmas lights including a base and handles on each end thereof whereby Christmas lights may be easily wound onto the carrier. The carrier includes cavities for accommodating electrical plugs associated with light strands.

U.S. Pat. No. 5,317,491 issued to Lee relates to a holder for light strands including a flat mounting plate having a plurality of mounting elements thereon to which lamps and lamp sockets are secured.

U.S. Pat. No. 5,287,965 issued to Miller relates to a light storage device constructed from corrugated cardboard. The device includes a vertical core section, a pair of horizontal end sections and a sheath. Lights are wrapped about the core and the sheath is placed thereabout.

U.S. Pat. No. 5,064,067 issued to McAllister et al. relates to a Christmas light organizer including a frame having two opposing sides with a series of tooth like projections extending outwardly therefrom forming gaps therebetween. A light strand is wrapped back and forth about the base member with the cord fitting into a gap.

U.S. Pat. No. 5,033,619 issued to Garis relates to a light string carrier including a lattice for holding a light string wrapped thereabout and a handle integral with the lattice. A cover having two hinge members is provided to overfit the lattice.

Each of the above described light strand organizers or storage devices require that a strand be manually wrapped or wound about a retainer. The present invention relates to a storage device having a rotating shaft therein about which a light strand may be wound by simply rotating a crank means. Furthermore, the device includes a unique closure means that provides convenient access to the wound strand allowing a single user to gradually unwind the strand while fastening it to a Christmas tree or similar object.

SUMMARY OF THE INVENTION

The present invention relates to a storage device for decorative light strands. The device comprises a housing having a bottom wall with a rear wall and a pair of side walls vertically extending therefrom. The top and front of the housing is open. Foldably attached to the front edge of the bottom wall is a flap formed of a plurality of independently foldable sections. The leading edge of the flap includes a tongue which may be inserted into a slot between the rear and bottom walls. Rotatably mounted within the housing interior is a shaft which may be rotated with a crank means to wind a light strand therearound. A pair of elastomeric retaining bands are mounted about the shaft, each for retaining a terminal end of the light strand. It is therefore an object of the present invention to provide a storage device for light strands that allows a user to conveniently wind the strand about a shaft.

It is another object of the present invention to provide a storage device for light strands that minimizes entangling thereof.

It is yet another object of the present invention to provide a storage device for light strands that includes a housing that can be selectively opened on both the top and front portion to provide more convenient access to the interior thereof.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
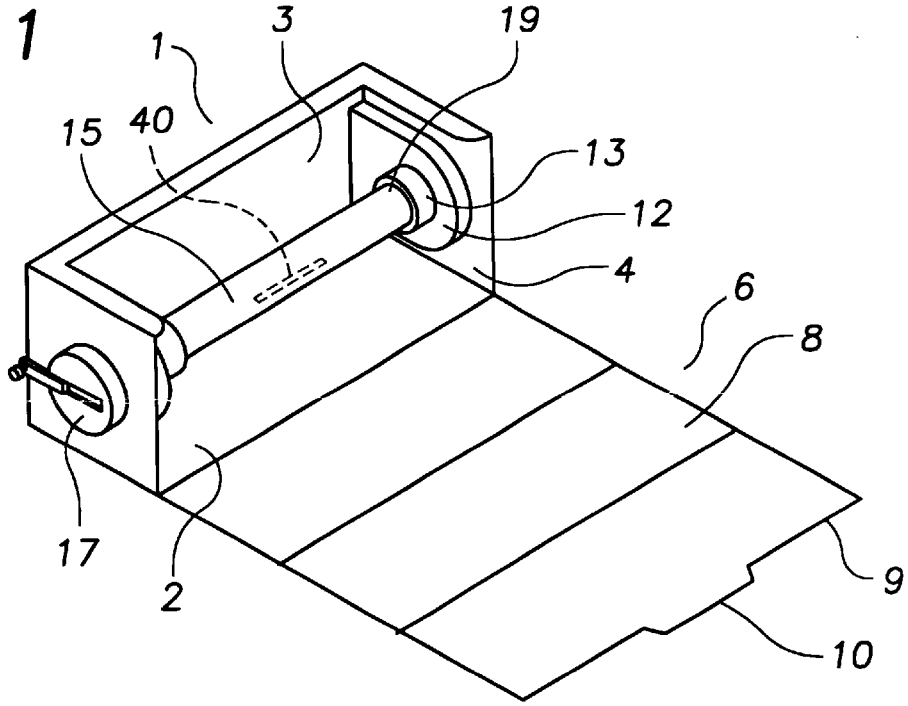
FIG. 1 is perspective view of the housing in an open position.
Figure 2:
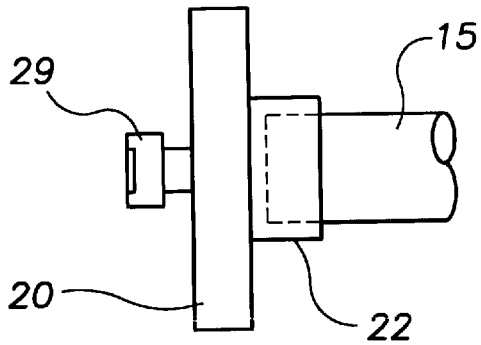
FIG. 2 is a side detailed view of the hand crank assembly.
Figure 3:
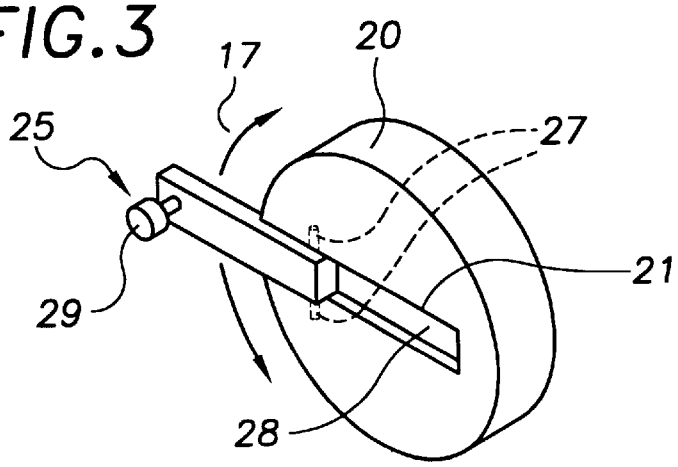
FIG. 3 is a close up perspective view of the hand crank assembly.

Referring now to FIGS. 1 through 3, the present invention relates a storage device for light strands. The device comprises a housing 1 having a bottom wall 2 with a rear wall 3 and two opposing side walls 4 extending upwardly therefrom. The various walls define an interior chamber. The housing also includes an open front portion and an open top portion. Foldably attached to the front edge of the bottom wall is a flap 6 formed of a plurality of independently foldable sections 8. A leading edge 9 of the flap includes a tongue 10 integral therewith which fits within a slit 40 formed between the rear and bottom walls. Accordingly, the flap may be folded upwardly and about the remainder of the housing to form a front wall parallel to the rear wall and top wall parallel to the bottom wall to completely enclose the interior chamber.

Attached to the rear wall are a pair of spaced brackets 12, each having an aperture 13 thereon. Received within each aperture and rotatable relative to the brackets is an elongated shaft 15. A pair of elastomeric bands 19 are mounted about the shaft, each for retaining an end of a light strand. A crank means 17 selectively rotates the shaft to wind a light strand thereabout. The crank means includes a substantially disk-shaped casing 20 rotably mounted to a side wall of the housing having a transverse slot 21 formed therein. The casing includes an inwardly facing side with a receptacle 22 thereon that extends into the interior chamber of the housing. An end of the shaft is received within the receptacle whereby rotation of the casing results in rotation of the shaft. The shaft may be secured within the receptacle using any conventional means.

A handle member 25 for rotating the casing includes a first end having a pair of opposing pins 27 extending therefrom, each of which is slidably received within a groove 28 formed within the casing slot. An opposing end of the handle includes a knob 29 threadedly attached thereto which is grasped by a user to rotate the handle and casing. The handle may be slid to an extended position as depicted in FIG. 1 when winding or unwinding a cord about the shaft. Alternatively, the handle may be retracted within or pivoted into the slot when the device is not in use.

To use the above described device, an end of a light strand to be stored is secured to the shaft by inserting the end beneath one of the elastomeric bands. The handle is extended and rotated in either direction to wind the strand about the shaft. When the strand is completely wound about the shaft, the opposing end is secured beneath the other retaining band. The flap may then be wrapped about the housing and fastened within the slit to enclose the strand therein. When needed, the flap can be unfolded and the strand can be easily dispensed and attached to a tree or similar object by gradually unwinding the strand.

As is readily apparent to those skilled in the art, the present invention provides a light strand storage device that conveniently stores and prevents entanglement of light strands. Furthermore, the unique design allows a sole user to hold the housing in one hand and gradually unwind and mount the strand with the other hand.

The housing is preferably constructed with cardboard while the shaft is preferably constructed with plastic. However, as will be readily apparent to those skilled in the art, size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A storage device for light strands comprising:

a hollow housing having an interior chamber and an open portion in communication therewith; said housing further including a bottom wall having a front edge with a rear wall with a pair of side walls upwardly extending therefrom and open top and front portions;

a shaft rotatably mounted within the interior chamber of said housing;

a crank means attached to said shaft for selectively rotating said shaft to wind a light strand therearound;

a flap foldably attached to the front edge of the bottom wall of said housing, said flap formed of a plurality of foldable sections whereby said flap is folded about the open front and top portion so that said foldable sections form a front wall parallel to said rear wall and a top wall parallel to said bottom wall to selectively enclose said interior chamber.

2. The storage device for light strands according to claim 1 wherein said flap includes a leading edge having a tongue extending therefrom that is insertable within a slit formed between said rear wall and said bottom wall to secure said flap to said housing.

3. The storage device for light strands according to claim 1 wherein said housing and said flap are constructed with cardboard whereby said housing is lightweight and pliable.

4. The storage device for light strands according to claim 1 wherein said crank means comprises:

a casing rotably mounted on one of said side walls of said housing and attached to said shaft, said casing having a slot formed therein;

a handle slidably received within said slot which is slidable between an extended and retracted position and pivotable relative to said casing whereby said handle is grasped by a user to rotate said casing and thus said shaft.

5. The storage device for light strands according to claim 1 further comprising a pair of elastomeric retaining bands mounted on said shaft, each of said bands for retaining an end of a light strand.

6. A storage device for light strands comprising:

a hollow housing having an interior chamber and an open portion in communication therewith;

a shaft rotatably mounted within the interior chamber of said housing;

a crank means attached to said shaft for selectively rotating said shaft to wind a light strand therearound;

a pair of elastomeric retaining bands mounted on said shaft, each of said bands for retaining an end of a light strand.

7. The storage device for light strands according to claim 6 wherein said housing includes a bottom wall having a front edge with a rear wall and a pair of side walls upwardly extending therefrom and open top and front portions; and a flap foldably attached to the front edge of said bottom wall, said flap formed of a plurality of foldable sections whereby said flap is folded about the open front and top portion so that said foldable sections form a front wall parallel to said rear wall and a top wall parallel to said bottom wall to selectively enclose said interior chamber.

8. A storage device for light strands according to claim 7 wherein said flap includes a leading edge having a tongue extending therefrom that is insertable within a slit formed between said rear wall and said bottom wall to secure said flap to said housing.

9. A storage device for light strands according to claim 7 wherein said housing and said flap are constructed with cardboard whereby said housing is lightweight and pliable.

10. A storage device for light strands according to claim 6 wherein said crank means comprises:

a casing rotably mounted on one of said side walls of said housing and attached to said shaft, said casing having a slot formed therein;

a handle slidably received within said slot which is slidable between an extended and retracted position and pivotable relative to said casing whereby said handle is grasped by a user to rotate said casing and thus said shaft.

* * * * *